US005954471A

United States Patent [19]

Cullen

[11] Patent Number: 5,954,471

[45] Date of Patent: Sep. 21, 1999

[54] CRANE ATTACHMENT FOR A FRONT END LOADER

[76] Inventor: Michael J. Cullen, 2773 Wolfberry, NE., Albuquerque, N. Mex. 87122

[21] Appl. No.: 08/866,122

[22] Filed: May 30, 1997

[51] Int. Cl.[6] ..... B66C 1/10

[52] U.S. Cl. ..... 414/686; 414/724; 414/912; 37/403

[58] Field of Search ..... 414/724, 694, 414/686, 912; 212/175, 180, 258, 260, 255, 299, 294; 37/403

[56] References Cited

U.S. PATENT DOCUMENTS

| | | | |
|---|---|---|---|
| 2,301,808 | 11/1942 | Mosher . | |
| 2,733,817 | 2/1956 | Couse | 212/294 |
| 2,818,981 | 1/1958 | Heimbigner . | |
| 2,938,747 | 5/1960 | Pitts . | |
| 3,092,259 | 6/1963 | Swanson . | |
| 3,307,279 | 3/1967 | Tourneau . | |
| 3,460,696 | 8/1969 | Owen, Jr. . | |
| 3,527,362 | 9/1970 | Allen . | |
| 3,587,887 | 6/1971 | DeCarli . | |
| 3,812,979 | 5/1974 | Leihgeber . | |
| 4,159,058 | 6/1979 | Christenson et al. . | |
| 4,200,423 | 4/1980 | Sornsin . | |
| 4,425,072 | 1/1984 | Lewis . | |
| 4,523,684 | 6/1985 | Baisden . | |
| 4,540,096 | 9/1985 | Orvis . | |
| 4,579,504 | 4/1986 | Lemme et al. . | |
| 4,666,049 | 5/1987 | Gilmore, Jr. . | |
| 4,693,384 | 9/1987 | Gilmore, Jr. . | |
| 4,960,359 | 10/1990 | Lovitt, Jr. | 414/912 X |
| 5,000,269 | 3/1991 | Aoki et al. | 414/686 X |
| 5,120,186 | 6/1992 | Jorgenson . | |
| 5,140,760 | 8/1992 | Mannbro . | |

*Primary Examiner*—Donald W. Underwood

[57] ABSTRACT

A crane attachment for a front end loader includes arm members pivotally attached to a central portion of a forward each end of loader arm. Remote ends of the arms are joined together to form a triangular boom or truss structure. A cable or a chain extends from each arm of the loader to the remote ends of the arm members to support the truss structure. The length of the cable or chain can be adjusted, with a "come-along" or the like, to provide desired leverage and extension of the truss structure. A pulley is attached to the remote ends of the arm members and a winch cable runs through the pulley to permit an object to be lifted with the winch cable. The crane attachment can be used for lifting large objects, in place of a small crane. Also, the crane attachment can be laid back toward the operator cockpit to permit the loader bucket to be used without removing the crane attachment and the bucket need not be removed when using the crane attachment.

11 Claims, 5 Drawing Sheets

CRANE ATTACHMENT FOR A FRONT END LOADER

BACKGROUND OF THE INVENTION

1. Field of the Invention

The invention relates to crane attachments for construction equipment. In particular, the invention is a crane attachment for a front end loader that is easily installed and does not interfere with the normal operation of the front end loader.

2. Description of the Related Art

In the construction industry, labor and capital equipment costs are the primary variables that effect the cost of a particular project. Of course, in order to remain competitive, a construction contractor must minimize the cost of a project while meeting predetermined specifications. To this end, large machinery has been used to more efficiently handle tasks that were originally accomplished by hand, such as digging, lifting, and moving objects. For example, bulldozers (or graders) have been used to push large amounts of earth for grading and other tasks.

A bulldozer is typically a tractor-like machine having a blade mounted on a frame that extends forward of the tractor body of the bulldozer. The blade is used to push dirt or other objects that need to be moved. The blade can be moved up and down slightly relative to the body to compensate for slopes and other irregularities in the ground. However, a bulldozer is limited to pushing dirt or the like along the ground. In order to lift and move large amounts of dirt or the like, other machinery is necessary. Of course, construction machinery is expensive and is often rented by the hour or by the day. Therefore, limiting the amount of machinery used on a particular project, and making constant use of the available machinery is desirable to limit costs.

In view of this, a device known as a "front end loader" has been developed. A front end loader is the most versatile piece of construction machinery and thus has become the most widely used piece of construction machinery. A front end loader is capable of doing much of the work of a bulldozer and much more. A typical backhoe includes a basic 4-wheel tractor, an articulating arm (sometimes referred to as a backhoe) and a loader pivotally mounted to the tractor. The loader includes a pair of extending loader arms pivotally connected to the tractor, and a bucket pivotally mounted on free ends of the loader arms. Hydraulic cylinders, or the like, are mounted on the loader arms and controlled to cause the bucket to be positioned in various desired positions. The bucket can be lifted high over the tractor or placed on the ground. Further, the orientation of the bucket can be controlled to hold dirt or the like or to dump the same.

However, a front end loader does have some limitations. In particular, a conventional front end loader cannot easily lift large relatively fragile objects, such as HVAC (heating, ventilation, and air conditioning) units or the like. Also, a conventional backhoe cannot lift objects higher than the maximum height of the bucket of the loader and when objects are lifted high, the objects are dangerously positioned over the backhoe operator. Therefore, conventional front end loaders are not suitable for lifting large poles, prefabricated walls, HVAC units, septic tanks, other vehicles or equipment, large trees, or the like. Often such objects must be lifted on a construction sight and thus a crane is also necessary. Of course, the need for a crane increases the cost of the construction project.

To avoid the need for a separate crane, it is known to provide crane attachments for various construction machinery to increase the lifting versatility of the machinery. For example, U.S. Pat. No. 2,301,888 issued to Mosher discloses a crane attachment for a bulldozer. The crane attachment disclosed in Mosher is pivotally attached to the frame which supports the bulldozer blade. However, Mosher does not relate to front end loaders and thus the construction disclosed in Mosher does not address the complexities associated with mounting a crane attachment to a front end loader. In fact, the crane attachment disclosed in Mosher is not suitable for use on a front end loader for several reasons. Specifically, the crane attachment disclosed in Mosher has a curved lower portion that must be mounted on a substantially horizontal member, such as the frame of a bulldozer. This type of mounting cannot be accomplished on a front end loader because the hydraulics, muffler pipe, and other elements of a front end loader would interfere with a crane attachment mounted on a horizontal member. Since Mosher is directed to a bulldozer it does not address this problem. As noted above, bulldozers are not as versatile as front end loaders and are not as prevalent at construction sites. Therefore, Mosher falls short of providing a versatile machine for various lifting and moving tasks.

There have been several attempts at adapting a crane attachment for use with a backhoe. For example, U.S. Pat. No. 3,527,362 issued to Allen discloses a crane attachment for a backhoe that attaches to each end of the secondary arms through a complex set of arms and levers. Also, the crane attachment disclosed in Allen requires that the bucket of the backhoe be removed when the crane attachment is mounted on the secondary arms. Removal of the bucket is not easily accomplished in the field and, at best, is very time consuming. Also, because the crane attachment attaches to the secondary arms through a complex structure and must be coupled to the hydraulic system of the backhoe, each crane attachment must be specifically designed for a particular backhoe. Accordingly, the crane attachment disclosed in Allen cannot be readily deployed in the field and does not permit normal operation of the backhoe. Therefore, Allen falls short of providing a versatile machine for moving and lifting tasks.

U.S. Pat. No. 3,812,979 issued to Leihgeber discloses a crane attachment for a front end loader that does not require removal of the bucket. However, the crane attachment disclosed in Leihgeber mounts on the bucket and is fixed to the bucket. Therefore, the crane attachment must be removed to use the bucket. While the crane attachment disclosed in Leihgeber may be easier to deploy than the crane attachment disclosed in Allen, Leihgeber still falls short of providing a versatile machine for moving and lifting tasks because it does not permit normal operation of the front end loaders without removal of the crane attachment.

In summary, attempts have been made to increase the versatility of front end loaders by providing crane attachments. In attempting to adapt a crane attachment, such as that disclosed in Mosher, prior inventors have found it necessary to use complex connections between the crane attachment and the machinery which interfere with normal use of the machinery. Therefore, the prior art crane attachments introduce limitations. In particular, prior art crane attachments for front end loaders do not provide easy switching between use of the crane attachment and use of the front end loader in a conventional manner.

SUMMARY OF THE INVENTION

It is an object of the invention to overcome the limitations of the prior art discussed above.

It is another object of the invention to increase the versatility of a front end loader.

It is another object of the invention to permit a front end loader to lift large objects.

It is another object of the invention to permit a front end loader to safely lift objects high in the air.

It is another object of the invention to attach a crane attachment to a front end loader without significantly modifying the front end loader.

It is another object of the invention to allow a single crane attachment configuration to be readily attached to any front end loader.

It is another object of the invention to permit a crane attachment to be easily broken down and transported to a work site for attachment to a front end loader.

It is yet another object of the invention to permit selective use crane attachment of a and the loader bucket without the need to remove or attach any structural elements.

The objects above are attained by the invention which is a crane attachment for a front end loader, the crane attachment having arm members pivotally attached to a central portion of a forward portion of a loader arm of the front end loader. Remote ends of the arms are joined together to form a triangular boom or truss structure. A cable or a chain extends from each loader arm to the remote ends of the arm members to support the boom structure. The length of the cables or chains can be adjusted, with a "come-along" or the like, to provide desired leverage and extension of the boom structure. A pulley is attached to the remote ends of the arm members and a winch cable runs through the pulley to permit an object to be lifted with the winch cable. The crane attachment can be used for lifting large objects, in place of a small crane, without removing the loader bucket. Also, the crane attachment can be laid back toward the operator cockpit to permit the loader bucket to be used without removing the crane attachment.

BRIEF DESCRIPTION OF THE DRAWINGS

The invention will be described through a preferred embodiment illustrated in the attached drawing in which.

DETAILED DESCRIPTION OF THE PREFERRED EMBODIMENT

Figure 1:
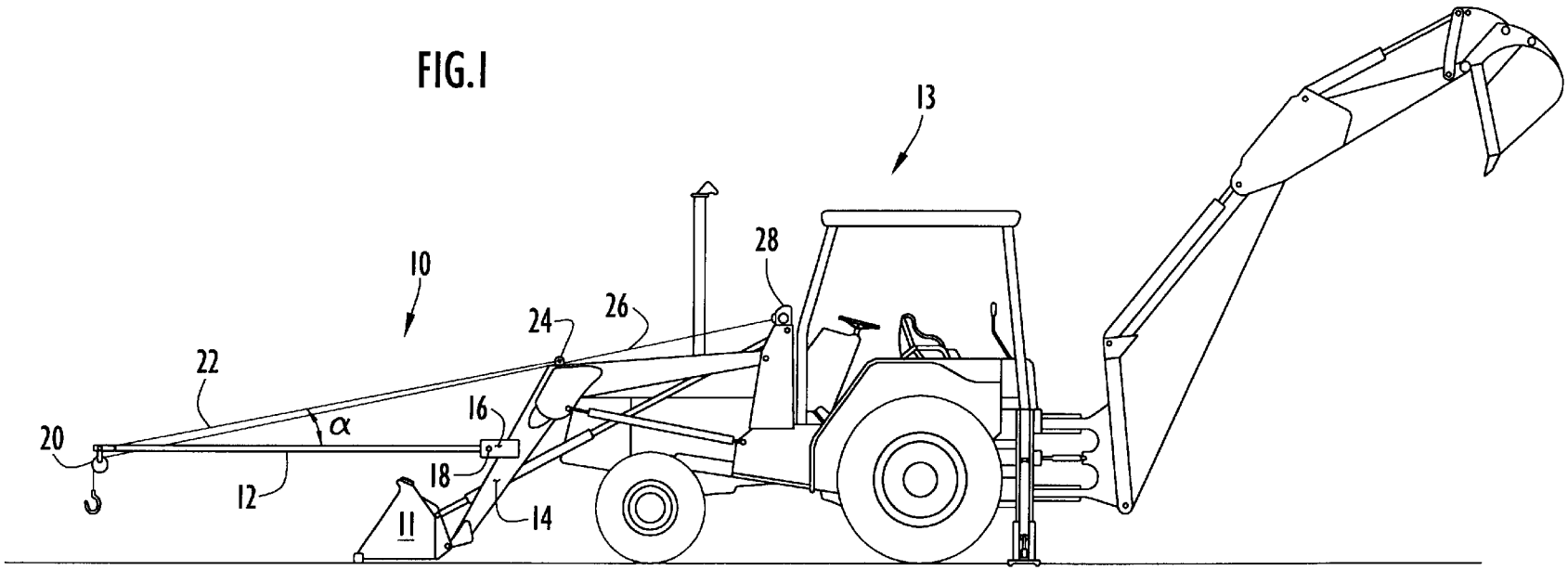
FIG. 1 illustrates a preferred embodiment of the invention on a typical front end loader with the crane lowered.

A preferred embodiment of the invention is illustrated in FIG. 1 and is shown attached to a conventional front end loader, such as a JD410™ sold by John Deere Co. However, the invention can be adapted to any front end loader. If necessary, the dimensions or configuration of the invention can be changed to accommodate the dimensions of different backhoes.

Figure 3:
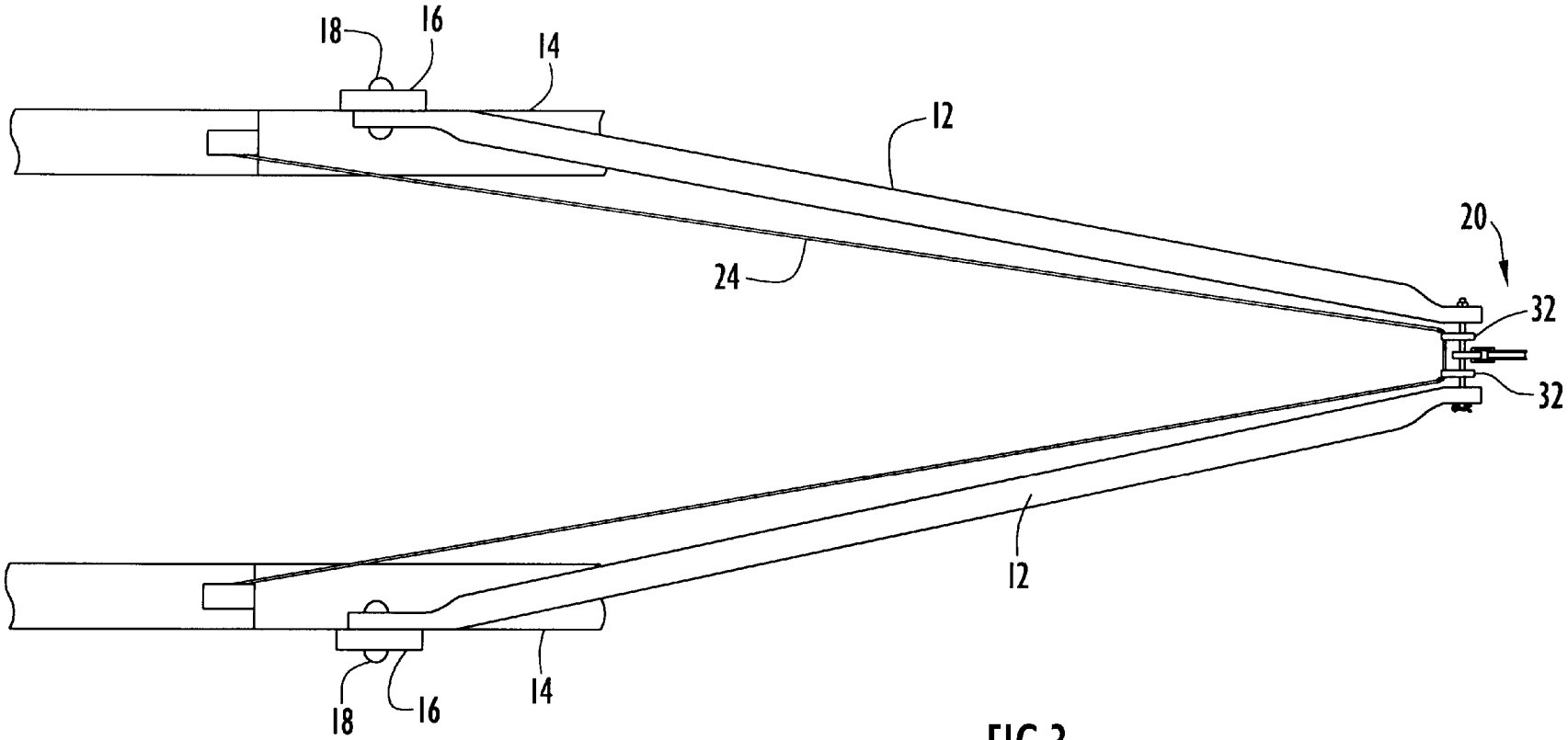
FIG. 3 is a top view of the preferred embodiment.

Crane attachment 10 includes a pair of arm members 12 extending respectively from loader arms 14 of front end loader 13. In particular, arm members 12 are pivotally connected to plates 16 that are fixed to a central portion of a forward section of loader arms 14 respectively. This is best illustrated in FIG. 3 which is a top view. Plates 16 can be welded, bolted, or otherwise affixed to loader arm 14 by any material with adequate strength characteristics. In the case of arm members 12 being made of pipe or tubing as in the preferred embodiment, an end of each arm member 12 can be flattened and a hole can be formed in the flattened portion. Each flattened portion is secured to a respective one of plates 16 by pin 18 extending through a hole formed in plate 16 and the flattened portion of the corresponding one of arm members 12. Pins 16 can be secured by a cotter pin or the like. Of course, arm members 12 can be secured to a central portion of the forward section of loader arms 14 in any manner that will achieve a pivotal mount with adequate strength, such as with a bolt or the like. Free ends of arm members 12 are secured to one another in the manner described below. Arm members 12 thus define a boom consisting of a triangular truss structure, with front end loader 13 constituting one of the truss members, when attached to loader arms 14 as illustrated in FIG. 3.

Figure 5:
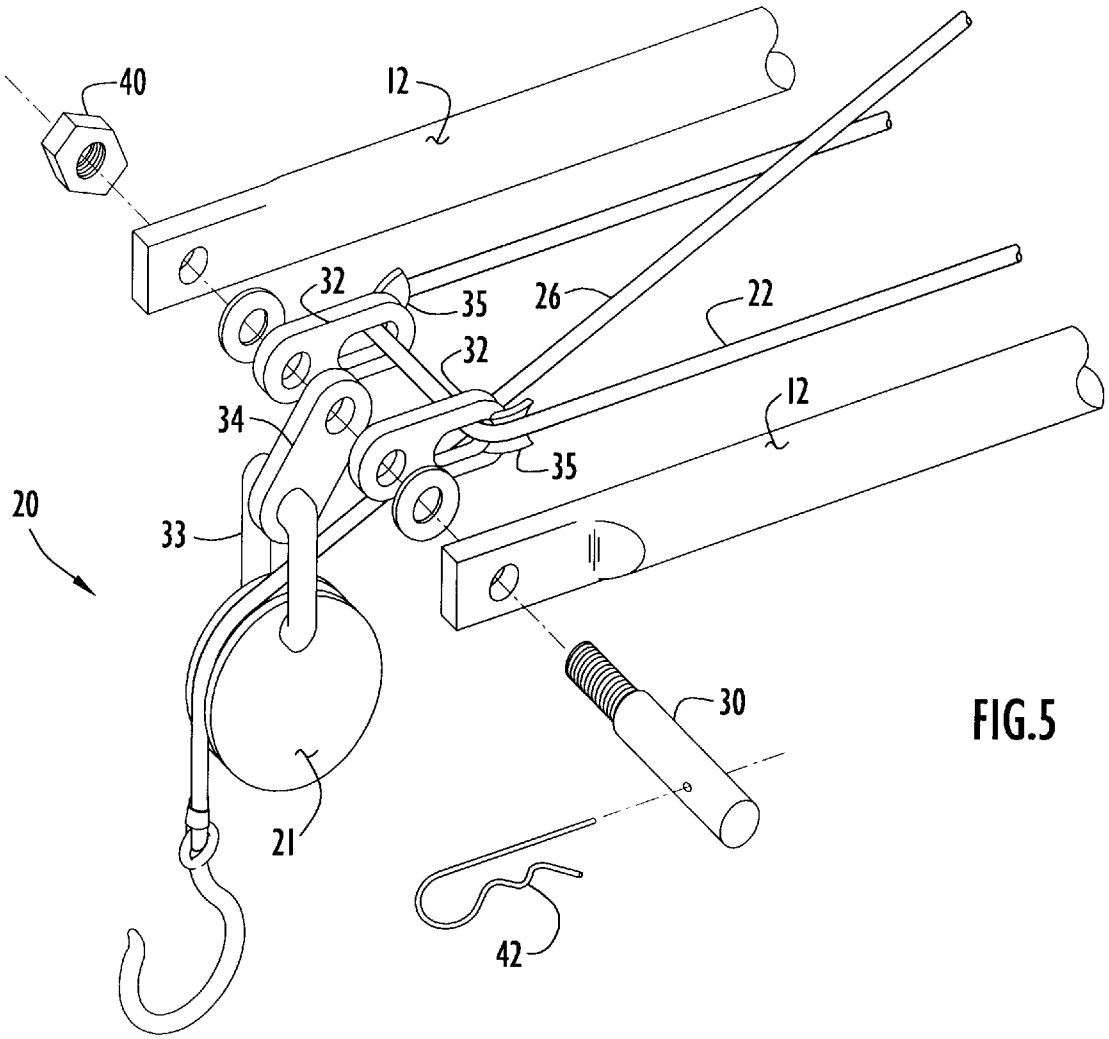
FIG. 5 is an exploded view of the pulley arrangement of the preferred embodiment.

Pulley arrangement 20 is pivotally mounted between the free ends of arm members 12 as illustrated in FIG. 5. Cable 26 extends from winch 28 mounted on front end loader 13 and extends through pulley arrangement 20 to hang from a free end of the truss structure where arm members 12 are joined together. A shackle, hook, magnet, or the like can be attached to the free end of cable 26 to permit attachment of cable 26 to an object to be lifted.

In particular, threaded fastener 30 passes through holes formed in connecting member 32 and through a hole formed in connecting member 34 as shown in FIG. 5. Nut 40 is disposed on one end of threaded fastener 30 and cotter pin 42 is disposed on the other end of threaded fastener 30. Pulley 21 is attached to connecting member 34 by shackle 33. Also, cable 22 passes through slots formed in connecting members 32. Guiding members 35 are disposed on connecting members 32 to prevent cable 22 from being damaged due to being bent sharply.

A connecting member in the form of a cable 22 extends from eyelet 24 on one loader arm 14 of backhoe 13, passes through connecting members 32 and terminates at eyelet 24 on the other loader arm 14. An adjustment device, such as a "come-along" or a turnbuckle, can be provided along the length of cable 22 to adjust the length of cable 22. Cable 22 supports the truss structure at a desired position, just above loader bucket 11 of front end loader 13 in the preferred embodiment. The leverage of crane attachment 10 can be adjusted according to practical considerations such as the size and weight of the object to be lifted, the lifting height, the amount of any movement after lifting, and the terrain, by adjusting the length of cable 22 which changes the angle of the truss structure with respect to cable 22. An angle $\alpha$ of 5° to 15° between cable 22 and the truss structure is preferable for most applications. An angle $\alpha$ of 11° has been found to be optimal.

Any front end loader can be retrofitted with crane attachment 10. Initially, plates 16 must be welded, or otherwise attached, to loader arms 14. This is most readily done in the shop with conventional welding techniques but can be accomplished in the field if necessary because a welder is available at most construction sites. Once plates 16 are attached to loader arms 14, plates 16 can remain thereon without interfering with operation.

When crane attachment 10 is to be coupled to front end loader 13 loader, bucket 11 is placed on the ground and crane attachment 10 is laid on the ground in front of bucket 11 with the flattened portions of arms 12 close to loader bucket 11. In this position, two human operators can lift the flattened portions up to plates 16 to align holes in the flattened portions with holes in plates 16 respectively. Pins 18 can then be inserted through the holes to pivotally fix arm members 12 to loader arms 14. In this state, the free end of the truss structure rests on the ground. Cable 22 is then attached to eyelets 24 and run through connecting members 32 to lift the free end of the truss structure and position arms 12 at the desired angle with respect to secondary arms 14.

The precise angle can be predetermined or adjusted at the work site based on the particular application by adjusting the length of cable 22 with a come-along or other adjusting device. Alternatively, a chain can be used in place of cable 22 and adjustment can be accomplished by placing hooks on the end of the chain, passing the hooks through eyelets 24 and then hooking the hooks on the chain itself at the desired position.

Cable 26 is then run from winch 28 to pass over pulley 21 of pulley arrangement 20 to permit the truss structure to be attached to an object by a hook, shackle, or the like, on the end of cable 26. Winch 28 is disposed on front end loader 13 directly in front of the driver in the preferred embodiment. However, winch 28 can be moved to increase visibility. For example, winch 28 can be disposed on one of the primary or secondary arms or on the roof of backhoe 13. Of course, controls for the winch should be placed within the operator's reach to permit a single operator to control front end loader 13 and crane attachment 10.

Figure 2:
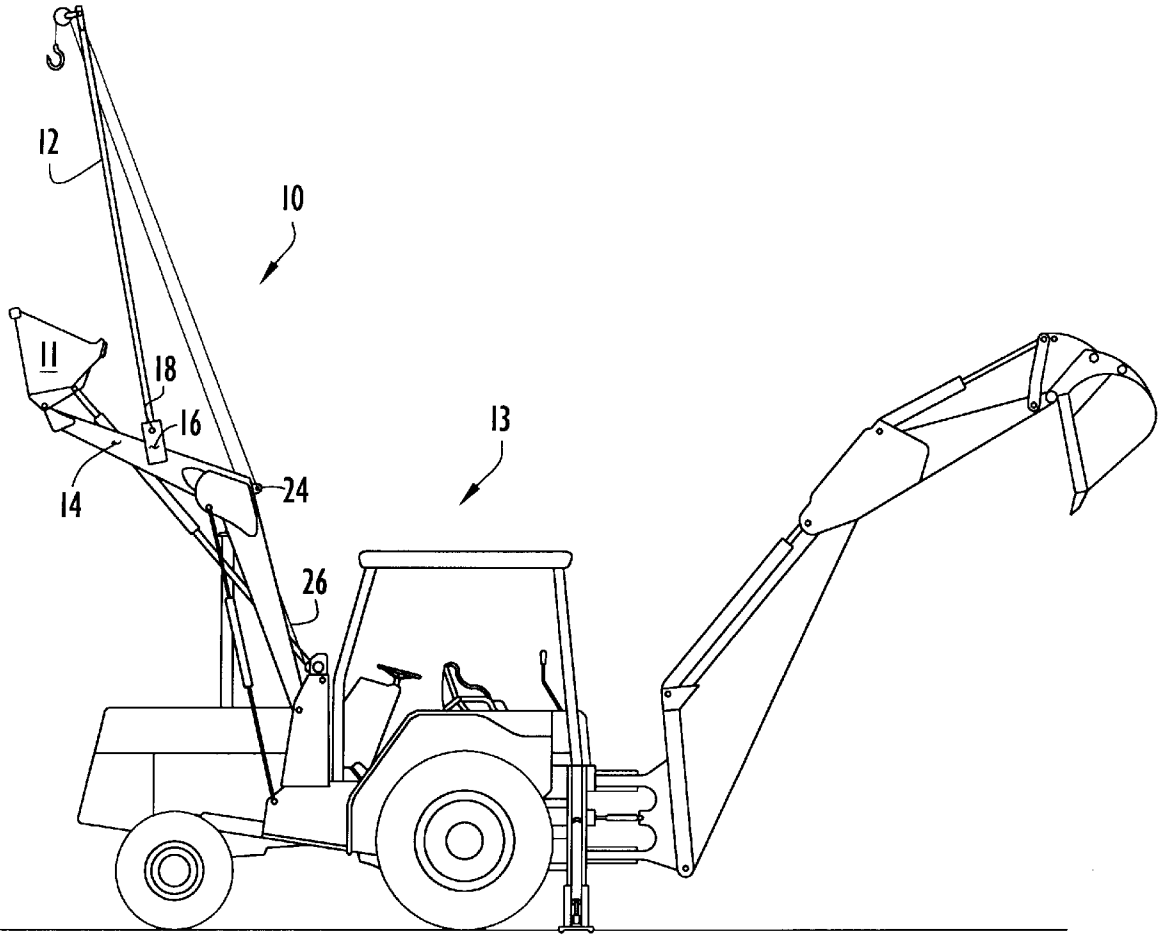
FIG. 2 illustrates the preferred embodiment of the invention with the crane in a raised position.

After the above-assembly procedure, which can be accomplished by two people in about 10 minutes, crane attachment 10 is ready for use. The hook on the end of cable 22 is attached to the object to be lifted, such as a prefabricated wall, a large pole, or any other object. Winch 28 is then operated to remove slack from cable 22. In this state, crane attachment 10 can be moved to the raised state illustrated in FIG. 2 merely by operating controls of front end loader 13 to raise bucket 11 in the conventional manner. It can be seen that raising the bucket causes loader arms 14 to be raised while cable 26 maintains the angle between loader arms 14 and arm members 12 thus causing crane attachment 10 to be moved to a raised position in which the object is raised off of the ground. The object can be raised or lowered merely by operating the controls of the front end loader in a conventional manner. This allows an operator to use crane attachment 10 without additional training. Alternatively, crane attachment 10 can be moved to a raised position with slack in cable 26 and winch 28 can be used to lift the object.

Figure 4:
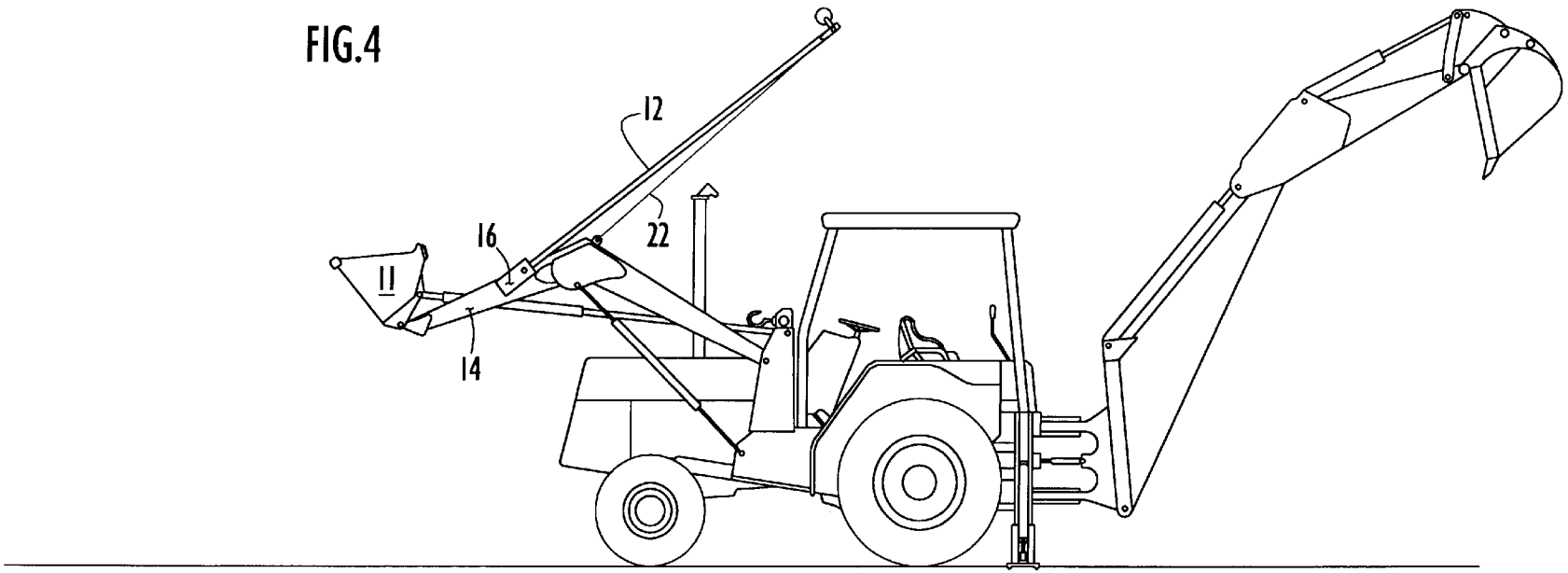
FIG. 4 illustrates the preferred embodiment in a stowed position allowing full use of the backhoe in a conventional manner.

With the object raised, front end loader 13 can be moved in a conventional manner to move the object and the object can be lowered when the proper location is reached. The object can be raised or lowered by raising or lowering crane attachment 10 or by operating winch 28. Note that winch 28 should be rated for overhead use for safety. For example, the RE 10,000 manufactured by RAMSEY™ can be used as winch 28. When use of crane attachment 10 is no longer needed, arm members 12 can be pivoted back against loader arms 14 as illustrated in FIG. 4. Arm members 12 can be fixed in this position by shortening cable 22 or by additional cables, chains, or the like tied around arm members 12 and secondary arms 14. Alternatively, crane attachment 10 can be detached from plates 16 and can be laid on a rack formed on the roof of front end loader 13, or stored on the ground or any other desired location, when not in use.

It can be seen that the invention provides a crane attachment for a front end loader that has very few parts and is easy to assemble and attach. Also, the invention allows the conventional controls of the front end loader to be used for lifting with the crane attachment. Further, the crane attachment is easily moved to and from a stowed position to permit the front end loader to be used in a conventional manner. The loader bucket need not be removed and the loader bucket can be used without removing the crane attachment. Also, virtually any front end loader can be retrofitted with the crane attachment of the invention merely by welding plates or other attaching means to central portions of the forward section of the loader. The connection to the central portion of the forward section of the loader arms permits the crane attachment to be attached to the front end loader without interfering with the normal operating components of the front end loader and without reducing the structural strength of the front end loader.

While the preferred embodiment has arm members that are connected essentially in the center of the forward portion of the loader arms, the arm members can be connected to virtually any portion of the forward portion of the loader arms that is far enough away from the ends of the forward portion of the loader arms to avoid interference with the operating components of the front end loader. Therefore, the phrase "central portion" as used herein is intended to mean any portion of the forward portion of the loader arms other than the very ends of the forward portion of the loader arms that are attached to the rear portion of the loader arms or the loader bucket. Also, the preferred embodiment has a connecting member constituted of a flexible member such as a cable or chain that extends from a top portion of the secondary arms to a pulley at the free end of the secondary arms. However, the connecting member can be any connecting member extending from a portion of the loader arm to a portion of the arm member remote from the loader arm. Also, the connecting member can be attached in any known manner. Of course, if the connecting member extends from a portion of the secondary arms that is below the central portion, the connecting member must be rigid in order to maintain the relative angle between the arm members and the loader arms. Alternatively, the arm members can be coupled to the loader arms in a non-pivotal manner and the connecting member can be omitted. Finally, there can be any number of arm members and the arm members can be connected in any configuration that provides adequate strength.

The pulley arrangement and associated connection of free ends of the arms can be varied. For example, the free ends can be welded together. Also, any means for attaching and positioning the various cables can be used.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A crane attachment for a front end loader, said front end loader including a loader bucket attached to a tractor by a loader arm, said loader arm including a forward portion attached to the loader bucket and a rear portion attached to the tractor, said crane attachment comprising:

at least one arm member;

attaching means for pivotally attaching a first end of said at least one arm member to a central portion of the forward end of the loader arm of a front end loader; and a connecting member connectable between said at least one arm member and a portion of the loader arm that is remote from the central portion of the forward end of the loader arm:

wherein the front end loader includes two loader arms and said crane attachment includes two arm members, each of said arm members being adapted to be respectively connected to a central portion of a forward end of a loader arm by said attaching means.

2. A crane attachment as claimed in claim 1 wherein said attaching means includes two plates, each of said plates having a hole formed therein and being fixedly attachable to a respective forward end of a loader arm, and two pins, each of said pins extending through one of said holes and an aperture formed in a respective one of said first ends of said arm members.

3. A crane attachment as recited in claim 1, further comprising:

a pulley arrangement disposed between second ends of said arm members; and a winch mountable on the front end loader and having a cable extending therefrom, said cable extending through said pulley arrangement.

4. A crane attachment and front end loader combination comprising:

a front end loader including a loader bucket attached to a tractor by a loader arm, said loader arm including a forward end attached to said bucket and a rear end attached to a said tractor;

at least one arm member;

attaching means for pivotally attaching a first end of said at least one arm member to a central portion of the forward end of the loader arm; and a connecting member extending from said at least one arm member to a portion of said loader arm that is remote from said central portion of said forward end of said loader arm.

5. The combination as claimed in claim 4 wherein said front end loader includes two loader arms and said crane attachment includes two arm members, each of said arm members being respectively connected to one of said central portions of said forward end of said loader arms by said attaching means.

6. The combination as claimed in claim 5 wherein said attaching means includes two plates, each of said plates having a hole formed therein and being fixedly attached to a respective one of said loader arms, and two pins, each of said pins extending through one of said holes and an aperture formed in a respective one of said first ends of said arm members.

7. The combination as recited in claim 4, further comprising:

a pulley arrangement disposed on a second end of said at least one arm member; and a winch mounted on said tractor and having a cable extending therefrom, said cable extending through said pulley arrangement.

8. The crane attachment as recited in claim 5, further comprising:

a pulley arrangement disposed between second ends of said arm members; and a winch mounted on said tractor and having a cable extending therefrom, said cable extending through said pulley arrangement.

9. A crane attachment and front end loader combination comprising:

a front end loader having a loader bucket attached to a tractor by at least one loader arm;

a crane attachment coupled to a central portion of a forward end of said at least one loader arm; and means connected between said crane attachment and said at least one loader arm for fixing the angle between said crane attachment and said at least one loader arm.

10. A crane attachment as claimed in claim 1 and further comprising a pair of eyelets, each of which is adapted to be respectively mounted on a portion of a loader arm that is rearwardly spaced from the central portion of the loader arm, and wherein said connecting member includes a flexible member adapted to be connected between at least one of said eyelets and one of said arm members.

11. A crane attachment as claimed in claim 10 wherein an opening is formed at a second end of at least one of said arm members and said flexible connecting member is configured to extend from a first of said eyelets to a second of said eyelets via said opening.

* * * * *